US006131362A

United States Patent [19]

Buecker

[11] Patent Number: 6,131,362

[45] Date of Patent: Oct. 17, 2000

[54] SHEET METAL BEAM

[75] Inventor: Robert V. Buecker, Melbourne, Ky.

[73] Assignee: Buecker Machine & Iron Works, Inc., Newport, Ky.

[21] Appl. No.: 09/241,584

[22] Filed: Feb. 2, 1999

Related U.S. Application Data

[60] Provisional application No. 60/073,871, Feb. 4, 1998.

[51] Int. Cl.[7] ..... E04C 3/07

[52] U.S. Cl. ..... 52/729.5; 52/729.1; 52/729.2; 52/731.2; 52/732.1; 52/737.1; 52/737.6; 29/897.35

[58] Field of Search ..... 52/729.1, 729.2, 52/729.5, 634, 636, 731.2, 731.3, 731.4, 732.1, 732.2, 732.3, 733.2, 737.1, 737.6; 29/897.31, 897.35

[56] References Cited

U.S. PATENT DOCUMENTS

| | | | |
|---|---|---|---|
| 132,087 | 10/1872 | Latrobe | 52/731.2 |
| D. 291,832 | 9/1987 | Lundstrom | D25/122 |
| 639,961 | 12/1899 | De Man . | |
| 774,484 | 11/1904 | Lufkin . | |
| 854,391 | 5/1907 | Voshardt | 52/729.3 |
| 991,603 | 5/1911 | Brooks | 52/729.5 X |
| 1,351,615 | 8/1920 | Brown et al. . | |
| 1,357,073 | 10/1920 | Mooney . | |
| 1,407,242 | 2/1922 | Wylie | 52/729.5 X |
| 1,924,880 | 8/1933 | Ragsdale . | |
| 2,049,926 | 8/1936 | Rafter . | |
| 2,303,631 | 12/1942 | Grant . | |
| 2,508,032 | 5/1950 | Kennedy | 52/729.5 X |
| 2,774,386 | 12/1956 | Formenti | 52/731.2 X |
| 3,066,772 | 12/1962 | Gibson . | |
| 3,079,649 | 3/1963 | Willatts | 52/731.2 X |
| 3,214,875 | 11/1965 | Slowinski et al. . | |
| 3,256,670 | 6/1966 | Tersigni | 52/634 |
| 3,288,489 | 11/1966 | Jahn . | |
| 3,328,931 | 7/1967 | Smith . | |
| 3,342,007 | 9/1967 | Merson | 52/729.5 |
| 3,491,853 | 1/1970 | Stillman, Jr. . | |
| 3,492,772 | 2/1970 | Bergman . | |
| 3,670,555 | 6/1972 | Fredericks | 29/897.35 X |

(List continued on next page.)

FOREIGN PATENT DOCUMENTS

| | | | |
|---|---|---|---|
| 494796 | 3/1930 | Germany | 52/729.2 |
| 580943 | 7/1933 | Germany | 52/729.5 |
| 2459421 | 6/1976 | Germany | 52/729.5 |
| 872690 | 10/1981 | U.S.S.R. | 52/737.1 |
| 128663 | 7/1919 | United Kingdom | 52/731.2 |
| 2093886 | 9/1982 | United Kingdom | 52/729.5 |
| 2247033 | 2/1992 | United Kingdom | 52/634 |

OTHER PUBLICATIONS

Modern Trade Communications Inc., *Metal Home Digest,* Mar.–Apr. 1996; Cover, Table of Contents, and pp. 10,14.

Clark Cincinnati Steel Framing Systems, *Steel Framing Systems for the Construction Industry,* no date, 6 pages.

Light Beam Inc., Light Beam System Catalog for Light Beam Header, no date, pp. 1–11.

Light Beam Inc., Light Beam System Catalog for Light Beam Header, no date, pp. 1–7.

U.S. Steel Group, Advertisement for Steel Framing, no date.

Trus Joist Corporation, Advertisement for TJI Joists, no date, 2 pages.

*Primary Examiner*—Laura A. Callo

*Attorney, Agent, or Firm*—Wood, Herron & Evans, L.L.P.

[57] ABSTRACT

A building beam structure having two sheet metal chords and a sheet metal central web section disposed between the two chords. Each chord has an end wall with two opposed side walls extending therefrom and two angular support walls extending from the side walls. The angular support walls converge inwardly from the side walls toward the central web section. The central web section has a main web wall extending between one of the angular support walls on each of the chords. In addition, the central web section has a first web wall section extending from another of the angular support walls on one of the chords, and a second web wall section extending from another of the angular support walls on another of the chords.

28 Claims, 4 Drawing Sheets

U.S. PATENT DOCUMENTS

| | | | |
|---|---|---|---|
| 3,698,224 | 10/1972 | Saytes | 29/897.35 |
| 3,722,167 | 3/1973 | Rousey . | |
| 3,846,031 | 11/1974 | Adams . | |
| 3,928,950 | 12/1975 | Beynon . | |
| 4,069,638 | 1/1978 | Hasselqvist et al. . | |
| 4,257,206 | 3/1981 | Mieyal . | |
| 4,490,958 | 1/1985 | Lowe | 52/729.5 X |
| 4,549,383 | 10/1985 | Vukmanic et al. . | |
| 5,022,211 | 6/1991 | Scott | 52/729.4 X |
| 5,464,302 | 11/1995 | Menchetti | 52/731.2 X |
| 5,535,569 | 7/1996 | Seccombe et al. | 52/634 |
| 5,553,437 | 9/1996 | Navon | 52/729.1 |
| 5,842,318 | 12/1998 | Bass et al. | 52/653.1 |

SHEET METAL BEAM

CROSS REFERENCE TO RELATED APPLICATIONS

This application is a continuation application corresponding to provisional application Ser. No. 60/073,871, entitled "Sheet Metal Beam", filed on Feb. 4, 1998.

BACKGROUND OF THE INVENTION

This invention relates to construction materials and more particularly, to a new structural member.

Over the years, there have been several attempts to develop alternative construction materials to wood joists, rafters and studs. Even though the problems associated with wood, as a raw material, continue to increase in residential construction, wood remains the dominant structural material.

As world population and economic development increase, the demand for wood also increases, thereby placing significant pressures on our natural resources and other supplies of wood stock. The net result is a general increase in the price of wood. In addition, wood stock, as with other resources, experiences spot variations in price as a function of spot shortages caused by weather, transportation problems and other variables. Further, over the last several decades, the overall quality of wood stock has generally declined. The quality and price issues are even more dramatic for wood joists, that is, the structural members that extend horizontally between vertical walls and provide a subjacent for a floor or roof above the joist. Joist members are generally nominally, 2 inches thick, are nominally in a range of from six inches to 12 inches wide and are most often, ten feet and more in length. Thus, as the wood resource becomes more scarce, of generally lower quality and more expensive, larger wood structures, such as joists, which require high quality wood to provide the desired straightness over their lengths, are proportionally even more expensive.

In use, often to reduce costs, longer joists, for example, those over twelve feet, are fabricated from shorter pieces which are spliced together. Further, as with all wood products, wood joists are subject to damage from termites and other insects.

Several alternatives to the standard wood joist have been considered. For example, fabricated wood I-beams are commercially available from Trus Joist Corporation of Boise, Id. While such fabricated I-beams have the advantage of being manufactured to any length and having a predictable quality, such fabrications are relatively expensive.

Structural members made of steel are widely used in commercial office construction and are now beginning to be used in residential construction. Typically, steel structural members are used for wall studs to which a wall material, for example, wallboard, is attached. Rafters and ceiling joists are frequently integrated into a truss assembly. Such structural steel products are available from Clark-Cincinnati Steel Framing Systems of Cincinnati, Ohio.

A hybrid metal and wood I-beam structure is commercially available from Light Beam Inc. of Santa Monica, Calif. In this beam structure, a pair of sheet metal plates are clinched together to form an I-beam web section and wood members, for example, nominal 2×4 wood pieces, are attached to the web and form the top and bottom cords or flanges of the I-beam. Such a beam structure is fabricated from two identical sheet metal pieces which are attached with nails or other fasteners to the wood flanges. That structure again has some of the inherent disadvantages of an all wood beam, and has the further disadvantage of a relatively high cost to fabricate the hybrid sheet metal and wood structure.

Further, U.S. Pat. Nos. 3,342,007 and 2,049,926 illustrate different designs for a steel joist. However, in spite of the above, the use of substitutes for a standard wood joist in residential construction has been limited.

Consequently, there is a need for a substitute for the standard wood joist that does not have the limitations and disadvantages of known substitutes and provides a practical, higher quality joist structure for less cost.

SUMMARY OF THE INVENTION

The present invention provides a sheet metal joist that is less expensive, stronger, lighter and easier to use than the traditional wood joist. Further, the sheet metal joist of the present invention can be readily manufactured to any length and provided to a contractor without warpage or twisting. The sheet metal joist of the present invention is long-lasting and not susceptible to termite damage and an effective substitute for a traditional wood joist. The sheet metal joist of the present invention includes attachment walls that provide flat, vertical surfaces to which drywall and other building components may be easily attached using known fasteners. Further, the double-wall web construction of the present invention increases the material in the web plane between the top and bottom load bearing rails, thereby substantially strengthening the joist.

In accordance with the principles of the present invention and in accordance with one embodiment, the present invention provides a building beam structure having two sheet metal rails and a sheet metal central web section disposed between the two rails. Each rail has an end wall with two opposed side walls extending therefrom and two angular support walls extending from the side walls. the angular support walls converge inwardly from the side walls toward the central web section. The central web section has a main web wall extending between one of the angular support walls on each of the rails. In addition, the central web section has a first web wall section extending from another of the angular support walls on one of the rails, and a second web wall section extending from another of the angular support walls on another of the rails.

In one aspect of the invention, the side walls and central web section are substantially perpendicular to the end walls of the rails. In another aspect of the invention, one of the end walls is adapted to receive a load and the other of the end walls is adapted to rest on a surface, thereby supporting the beam and the load. In a further aspect of the invention, the rails and the central web section are made from a single piece of sheet metal.

These and other objects and advantages of the present invention will become more readily apparent during the following detailed description taken in conjunction with the drawings herein.

DETAILED DESCRIPTION OF THE INVENTION

Figure 1:
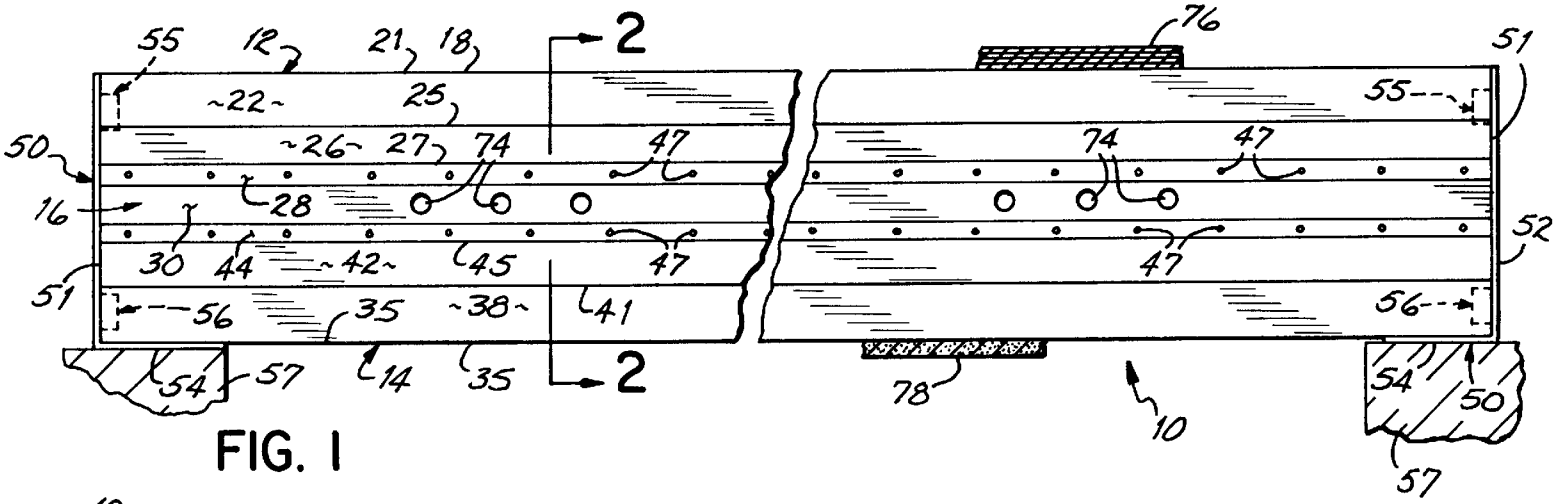
FIG. 1 is a side elevation view of the sheet metal beam in accordance with the principles of the present invention.
Figure 2:
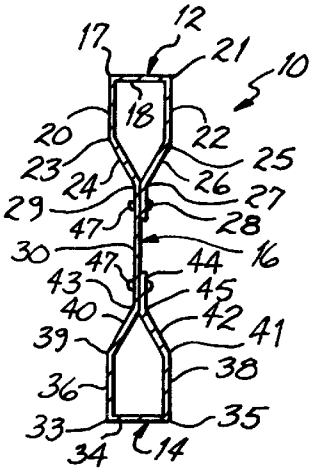
FIG. 2 is a cross-sectional view taken along line 2—2 of FIG. 1.

FIGS. 1 and 2 illustrate a sheet metal joist 10 having a first, upper chord or rail 12 and a second, lower chord or rail 14. The chords 12, 14 are joined by a connecting intermediate web section 16. One of the chords, 12, 14 and a connecting portion of the web section 16 may also be considered a beam component. The top chord 12 is shaped to form a polygon, and more specifically, a pentagon. The top chord 12 has a normally horizontal load-bearing upper surface or end wall 18 that extends longitudinally over the full length of the joist 10. The load-bearing surface 18 has longitudinally extending opposed lateral edges that are contiguous with, and intersect, longitudinally extending upper edges of respective opposed side walls 20, 22 to form respective corners 17, 19. The two side or fastening walls 20, 22 are generally parallel and generally perpendicular to the load-bearing surface 18 and are normally oriented in the generally vertical direction. The fastening or side walls 20, 22 provide flat fastening surfaces to which materials may be connected in the normal course of construction. The fastening walls 20, 22 having longitudinally extending lower edges that are contiguous with, and intersect, longitudinally extending upper edges of respective angular support walls 24, 26 to form respective corners 23, 25. The support walls 24, 26 converge inwardly toward the centrally located web section 16. The angular support wall 24 has a longitudinally extending lower edge that is contiguous with, and intersects, a longitudinally upper edge of a main web wall 30 to form a bend or corner 29. The angular support wall 26 has a longitudinally extending lower edge that intersects and is contiguous with a longitudinally upper edge of a first web wall section 28 to form a bend or corner 27.

The bottom chord 14 is generally the same shape and normally the same size as the top chord 12. The bottom chord 14 has a normally horizontal lower surface or end wall 34 generally parallel with the opposing end wall 18. The end wall 34 has longitudinally extending opposed lateral edges that are contiguous with, and intersect, longitudinally extending lower edges of opposed respective side walls 36, 38 to form respective corners 33, 35. The fastening or side walls 36, 38 are generally parallel and generally perpendicular to the end wall 34, are normally vertical and provide further flat, fastening surfaces. The fastening walls 36, 38 have longitudinally extending upper edges that are contiguous with and intersect longitudinally extending lower edges of respective angular support walls 40, 42 to form respective bends or corners 39, 41. The angular support walls 24, 26 converge inwardly toward the centrally located web section 16. The angular support wall 40 has a longitudinally extending upper edge that is contiguous with and intersects a longitudinally extending lower edge of the main web wall 30 to form a bend or corner 43. The angular support wall 42 has a longitudinally extending upper edge that is contiguous with and intersects a longitudinally extending lower edge of a second web wall section 44 to form a bend or corner 45.

The web wall sections 28, 44 are rigidly connected to the main web wall 30 using known fastening devices 47, for example, rivets, TOG-L-LOCK fasteners, sheet metal screws, bolts, etc. Alternatively, the web wall sections 28, 30, 44 are connected by fastening devices such as adhesives, spot welding, seam welding, and other joining mechanisms known in the art. The application of the fastening devices adds substantial strength and rigidity to the beam structure especially in a direction parallel to a plane of the intermediate web section 16 which is normally the vertical direction. The sheet metal joist of FIGS. 1 and 2 is normally formed by rolling a continuous piece of the sheet metal stock over a plurality of dies. While preferably the joist is made from approximately 20-gauge thick sheet metal, the sheet metal thickness may vary in the range of from approximately 16-gauge to approximately 24-gauge, depending upon the application and the capacity of the roll-forming machine. The heights of the fastening surfaces 20, 22, 36, 38 and the height of the web wall 30 may be varied to vary the nominal size of the joist, for example, from a 2×8 joist to a 2×12 joist. The joists are cut to their desired nominal lengths either before or after the fabrication process.

Figure 3:
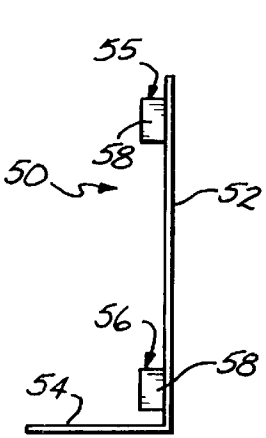
FIG. 3 is a an end view of an end piece to be used with the sheet metal beam.
Figure 4:
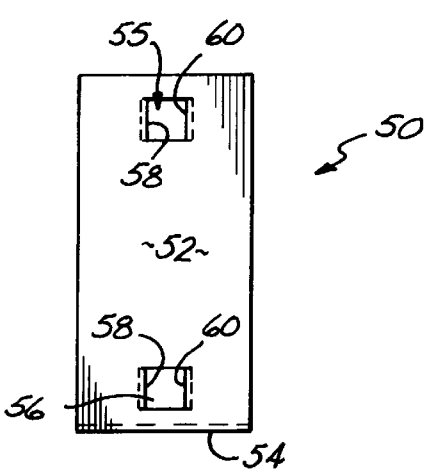
FIG. 4 is a front elevation view of the end piece of FIG. 3.

FIGS. 3 and 4 illustrate an end plate 50 which may be used to terminate the ends 51 of joist 10. The end plate is preferably L-shaped with a generally vertical nailing plate 52 that intersects a generally horizontal locating plate 54. As will be appreciated, the plate 54 is optional depending on the application. The nailing plate 52 has centrally located upper and lower flange pairs 55, 56, respectively. Each flange pair has opposed flanges 58, 60 which are separated to fit adjacent to the fastening walls 20, 22, 36, 38 within the cavities bounded by the walls of the top and bottom chords 12, 14.

In use, a joist of the desired length is selected and the end plates 50 are mounted at the ends 51 of the joist 10. The assembly of the joist 10 and end plates 50 is positioned at its desired general location. The width of the locating plates 54 of the end plates 50 are more than twice the nominal width of the joist 10; and therefore, the locating plates 54 stabilize the joist 10 in its desired generally vertical orientation. The lower end wall 34 of the joist 10 is normally positioned on top of a structural element 57, for example, foundation walls, metal I-beams or metal or wood stud walls. When the joist 10 is located in its desired position, it may be secured in that position by applying nails or other fasteners through the nailing plates 52 or the locating plates 54.

Sub-flooring 76 is attached to the upper load-bearing surfaces of end walls 18 by known fasteners, and drywall or other ceiling material 78 is attached to the lower surfaces 34 by known means. After the joist is secured in place, plumbing and electrical utilities are then installed. The joist 10 is normally manufactured with holes 74 that extend through the web section 16; and the holes 74 are sized to receive pipes and/or wires, thereby facilitating the installation of the plumbing and electric utilities. The holes 74 may be made as part of the joist fabrication or made on-site in the field.

Figure 5:
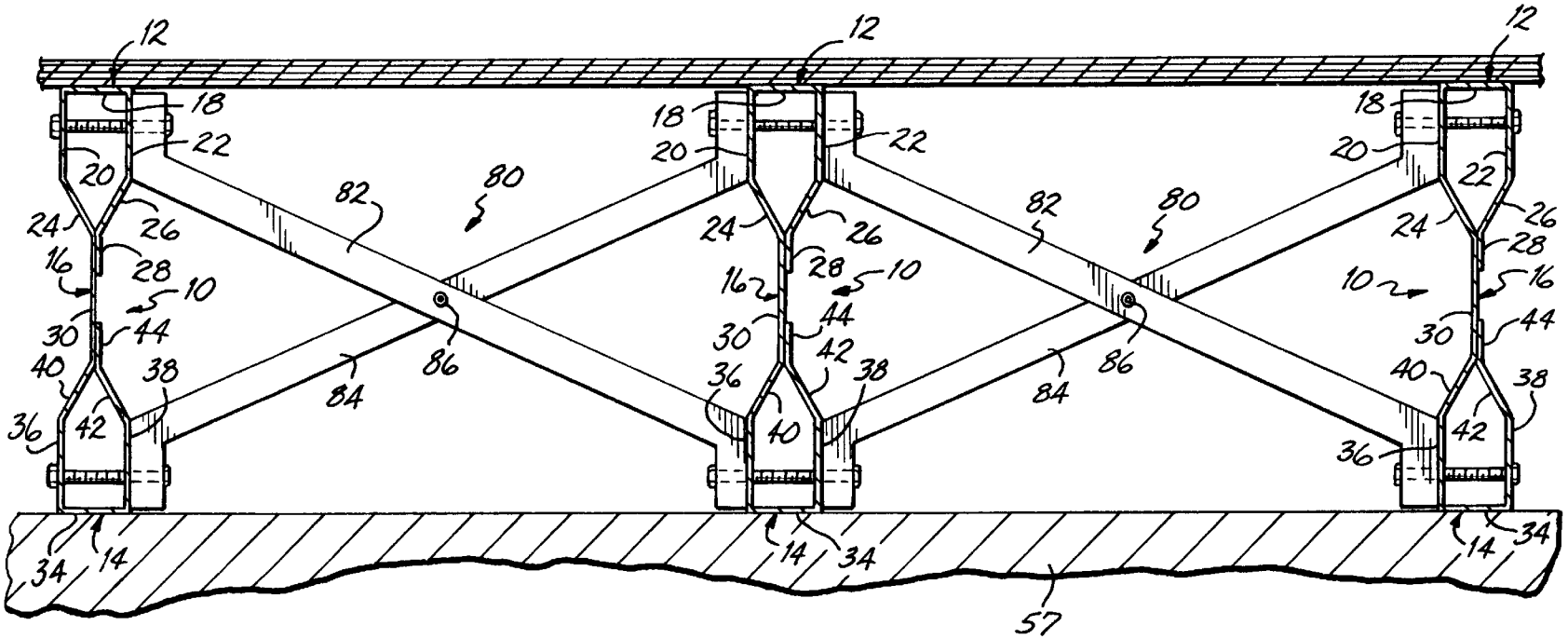
FIG. 5 is a partial cross-sectional view of bridging used with sheet metal joists of the present invention.

As illustrated in FIG. 5, bridging 80 may be installed between the joists 10. Bridging is normally fabricated to provide an X-shaped structure having two legs 82, 84. Leg 82 has one end connected to the top chord 12 of a first joist and has the opposite end connected to a bottom chord 14 of an adjacent joist. The leg 84 is connected at one end to the bottom chord 14 of the first joist and is connected at its opposite end to the top chord 12 of the adjacent joist. For increased strength, the bridging legs 82, 84 are connected together with a fastener 86. In a totally metal construction, the bridging legs 82, 84 may be formed from metal tubing that is 16-gauge and nominally 0.625 inch or 0.75 inch across. Either square or round tubing may be used. While two bridging legs 82, 84 are illustrated in FIG. 5, bridging with a single leg will provide more strength than no bridging, but provides less strength than the full cross-bridging illustrated in FIG. 5. The bridging legs 82, 84 may also be made from materials other than metal, for example, wood.

Figure 6:
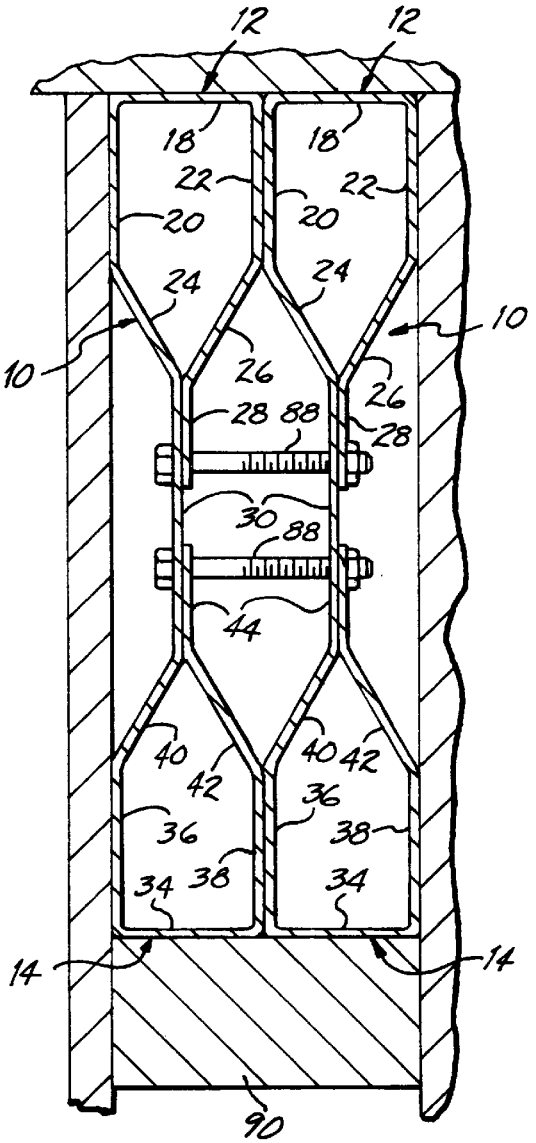
FIG. 6 is a cross-sectional view of the sheet metal joists being used as a lintel.

While the sheet metal joists may be used to support floors and ceilings as illustrated in FIG. 1, they may also be used to provide a header or lintel above a window or door. As illustrated in FIG. 6, two sheet metal joists 10 are connected together by fasteners 88 extending it through the web walls 30 of the joists 10. The joists 10 are located immediately above a window frame section 90 and function to support the structure located above the window or door.

Figure 7:
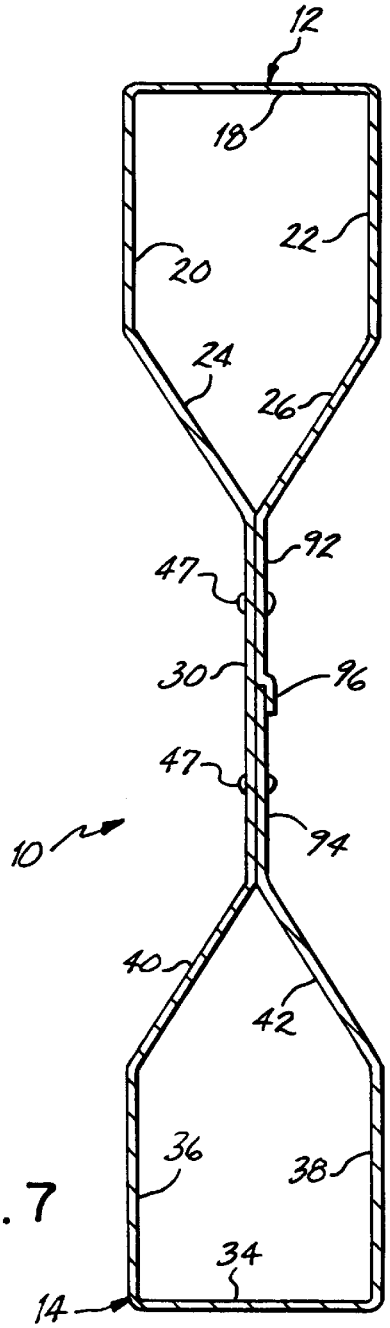
FIGS. 7–12 are cross-sectional views of alternative embodiments of the sheet metal joist in accordance with the principles of the present invention.

FIG. 7 illustrates an alternative embodiment of the joist 10 with respect to the web wall 16. The web wall 16 contains a continuous web wall portion 30 as described with respect to FIG. 2. However, the angular support walls 26, 42 intersect web wall portions 92, 94 that extend over the full length of the web wall 30, and in addition, have an overlapping portion 96. In the alternative embodiment, the web wall portions 30, 92, and 94 are joined together by fasteners 47 as previously described with respect to FIG. 1. Depending on the length of the overlapping section 96, fasteners may be applied through the section 96. Alternatively, the section 96 may be welded or not connected at all.

The sheet metal joist heretofore described provides a substitute for a traditional wood joist that is stronger, lighter, competitively prices and easier to use than the traditional wood joist. Further, the sheet metal joist can be readily manufactured to any length and provided to the contractor without warpage or twisting. In addition, the sheet metal joists are long-lasting and not susceptible to termite damage.

The sheet metal joist includes attachment side walls 20, 22, 36, 38 that provide flat, vertical surfaces to which drywall and other building components may be easily attached using known fasteners. Further, the double-wall construction of the web 16 increases the material in the plane between the top and bottom chords, thereby substantially strengthening the joist.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the sheet metal joists can be designed to have different strengths by using different carbon steel sheet metals or an alloy, as well as varying the gauge of the sheet metal.

Figure 8:
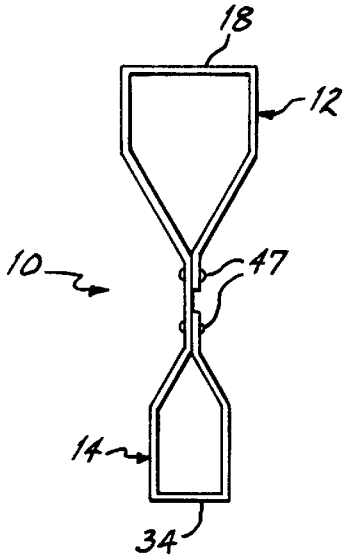
Figure 9:
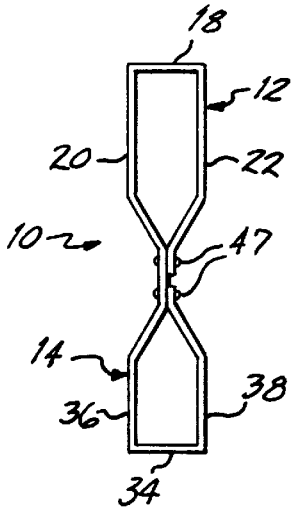

Further, the basic configuration of the building sheet metal beam structure can be modified as illustrated in FIGS. 8–12 for different applications and/or to satisfy different manufacturing requirements and specifications. For example, as shown in FIG. 8, the widths of the end walls 18, 34 of the respective upper and lower chords 12, 14 can be different; and as shown in FIG. 9, the height of the side walls 20, 22 of the upper chord 12 can be substantially different from the height of the side walls 36, 38 of the lower chord 14. FIGS. 8 and 9 further demonstrate that the ratio of the width of the chord to its height can be varied to suit a particular application.

Figure 10:
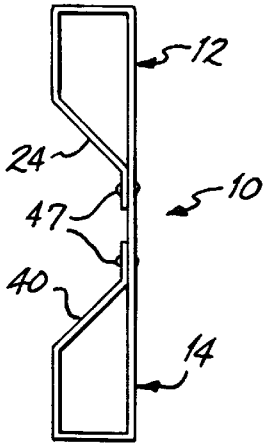
Figure 11:
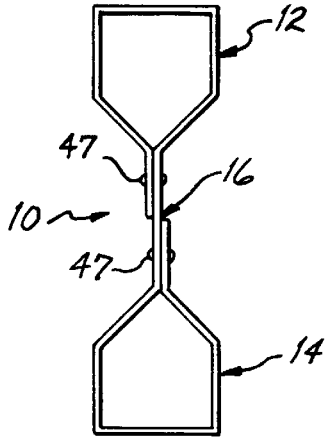

FIG. 10 is a further embodiment in which only one angular support wall 24, 40 is used with each of the respective upper and lower chords 12 and 14. FIG. 11 illustrates another embodiment of the beam in which the upper and lower chords 12, 14 are folded in the same direction, for example, counterclockwise, from the central web section 16. In contrast with the other embodiments, the upper and lower chords fold in opposite directions. For example, referring to FIG. 8, in moving from the web section, the upper chord 12 folds in a clockwise direction; and the lower chord 14 folds in a counterclockwise direction.

Figure 12A:
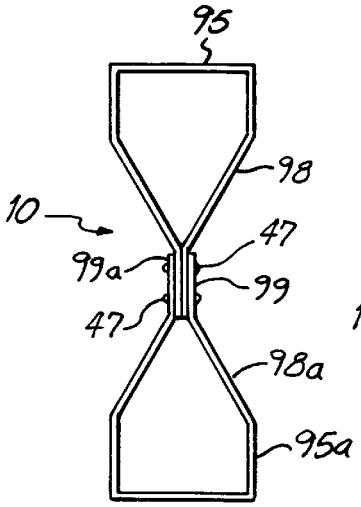
Figure 12B:
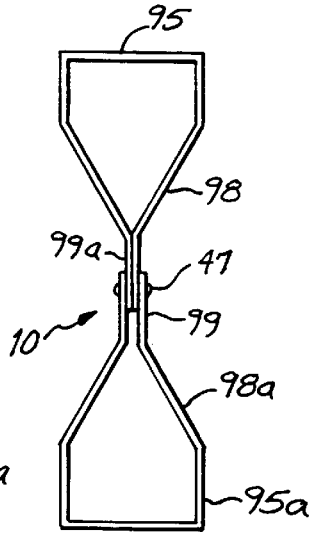

FIGS. 12*a* and 12*b* illustrate an embodiment in which the beam structure is made from two beam components 95, 95*a*. Each component has a chord section 98, 98*a* and a web wall section 99, 99*a*. The beam components 95, 95*a* are positioned with respect to each other such that the web wall sections overlap, and the overlapping web wall sections are joined by the fastening devices 47, for example, rivets, bolts, spot welds, electric welds, adhesives, etc. As shown in FIG. 12*b*, the components 95, 95*a* can be connected together at different relative positions, thereby permitting the beam 10 to be fabricated to different nominal heights. Further, if there is some variation in the manufacture of the components 95, 95*a*, the components can be fixtured and fastened together to achieve a beam having a highly uniform height over its length. In addition, as will be appreciated, the pairs of web wall sections may be of different lengths, so that a shorter web wall section of each component is joined to longer web wall sections of the two components.

While the normal application of the sheet metal beam of the present invention is intended to be in residential building construction, the sheet metal beam can be used in garages and other utility buildings, in commercial buildings, in barns, sheds and other farm buildings, landscaping structures, in bridges, as concrete reinforcement in roads and other infrastructure construction.

Therefore, the invention in its broadest aspects is not limited to the specific details shown and described. Consequently, departures may be made from the details described herein without departing from the spirit and scope of the claims which follow.

What is claimed is:

1. A building beam structure comprising:

two sheet metal chords, each of the chords having a flat end wall, two opposed side walls extending from the end wall and having respective flat fastening surfaces to which materials may be connected, and two angular support walls, each of the angular support walls extending from one of the side walls, and the angular support walls converging inwardly from the side walls; and a sheet metal central web section disposed between the two chords and including a planar main web wall extending straight between one of the angular support walls on each of the chords, a first web wall section extending from another of the angular support walls on one of the chords, and a second web wall section extending from another of the angular support walls on another of the chords.

2. A building beam structure of claim 1 further comprising fastening devices connecting the first and second web wall sections with the main web wall.

3. A building beam structure of claim 1 wherein the two sheet metal chords and the sheet metal central web section are made from a single piece of sheet metal.

4. A building beam structure of claim 1 wherein the two sheet metal chords and sheet metal central web section are made from a single piece of sheet metal having a thickness in the range of from approximately 16-gauge to approximately 24-gauge.

5. A building beam structure of claim 1 wherein the two sheet metal chords and sheet metal central web section are made from a single piece of approximately 20 gage sheet metal.

6. A building beam structure of claim 1 wherein the end wall of one chord is substantially parallel to the end wall of the other chord.

7. A building beam structure of claim 1 wherein the side walls are substantially perpendicular to each end wall.

8. A building beam structure of claim 1 wherein the central web section is substantially perpendicular to each end wall and substantially parallel to the side walls.

9. A building beam structure of claim 1 wherein each end wall is disposed in a generally horizontal direction and the central web section is disposed in a generally vertical direction.

10. A building beam structure of claim 1 wherein each end wall on each of the chords has two opposed longitudinal lateral edges.

11. A building beam structure of claim 10 wherein each of the two side walls on each of the chords has first and second longitudinal edges with the first longitudinal edge of each of the side walls being connected to one of the longitudinal lateral edges of one of the end walls.

12. A building beam structure of claim 11 wherein each of the two angular support walls on each of the chords has first and second longitudinal edges with the first longitudinal edge of each of the angular support walls being connected to the second longitudinal edge of one of the side walls.

13. A building beam structure of claim 12 wherein the main web wall of the central web section further comprises two longitudinal edges with one of the longitudinal edges being connected to the second longitudinal edge of one of the angular support walls on one of the chords and the other of the longitudinal edges being connected to the second longitudinal edge of one of the angular support walls on the other of the chords.

14. A building beam structure of claim 13 wherein the first web wall section of the central web section further comprises a longitudinal edge connected to the second longitudinal edge of the other of the angular support walls on one of the chords.

15. A building beam structure of claim 14 wherein the second web wall section of the central web section further comprises a longitudinal edge connected to the second longitudinal edge of the other of the angular support walls on the other of the chords.

16. A building beam structure of claim 1 further comprising a plurality of holes spaced longitudinally along the central web section and sized to receive apparatus for utilities.

17. A building beam structure of claim 1 wherein one of the side walls of one chord is coplanar with one of the side walls of the other chord, and the other of the side walls of the one chord is coplanar with the other of the side walls of the other chord.

18. A building beam structure comprising:

upper and lower sheet metal chords, each of the chords having a flat end wall, two opposed side walls extending from the end wall and having respective flat fastening surfaces to which materials may be connected, and two angular support walls, each of the angular support walls extending from one of the side walls, and the angular support walls converging inwardly from the side walls;

sheet metal planar web walls extending from the angular support walls intermediate the upper and lower chords; and fastening devices connecting the web walls together, thereby providing a sheet metal beam structure having upper and lower chords and an intermediate web.

19. A building beam structure of claim 18 wherein the web walls further comprise a main web wall extending between one of the angular support walls on each of the upper and lower chords, a first web wall section extending from another of the angular support walls on the upper chord, and a second web wall section extending from another of the angular support walls on the lower chord, the fastening devices connecting the first and second web wall sections with the main web wall.

20. A building beam structure of claim 18 wherein the web walls further comprise a first pair of web wall sections, each of the first pair of web wall sections extending from one of the angular support walls on the upper chord, a second pair of web wall sections each of the second pair of web wall sections extending from one of the angular support walls on the lower chord.

21. A building joist structure comprising:

first and second sheet metal chords, each of the chords having a flat end wall with opposed longitudinal lateral edges, two generally parallel side walls, each of the side walls having a longitudinal first edge extending from one of the longitudinal lateral edges of the end wall, a longitudinal second edge, and a flat fastening surface between the first and second longitudinal edges of the side wall to which materials may be connected, two angular support walls converging inwardly from the side walls, each of the support walls having a longitudinal first edge extending from the longitudinal second edge of the side wall, and a longitudinal second edge;

a sheet metal central web section connected between the two chords and including a planar main web wall having a longitudinal first edge extending from the longitudinal second edge of the one of the support walls on the first chord, and a longitudinal second edge extending from the longitudinal second edge of one of the support walls on the second chord, and a first web wall section having a longitudinal first edge extending from the longitudinal second edge of another of the support walls on the first chord, and a second web wall section having a longitudinal first edge extending from the longitudinal second edge of another of the support walls on the second chord, the first and second web wall sections extending adjacent the main web wall; and fastening devices connecting the first and second web wall sections with the main web wall.

22. A building joist structure comprising:

a single sheet metal piece having upper and lower opposed chords connected by a generally vertical web section;

each of the chords having five walls including a generally horizontal flat end wall, two generally vertical side walls connected along upper longitudinal edges to the end wall, the side walls having respective flat fastening surfaces to which materials may be connected, and two angular support walls connected along upper longitudinal edges to lower longitudinal edges of the vertical side walls, the angular support walls converging inward from the vertical side walls; and the web section including a first planar web wall connected to first angular support walls on each of the top and bottom chords, a second web wall connected to a second angular support wall on the upper chord, and a third web wall connected to a second angular support wall on the lower chord.

23. A building beam structure of claim 22 further comprising fastening devices connecting the second and third web walls with the first web wall.

24. A building beam structure of claim 23 further comprising a plurality of holes spaced longitudinally along the central web section and sized to receive apparatus for utilities.

25. A building beam structure of claim 23 wherein one of the side walls of one chord is coplanar with one of the side walls of the other chord, and the other of the side walls of the one chord is coplanar with the other of the side walls of the other chord.

26. A building beam structure comprising:

two sheet metal chords, each of the chords having a flat end wall, two opposed side walls extending from the end wall and having respective flat fastening surfaces to which materials may be connected, and one angular support wall, the angular support wall extending from one of the side walls, and the angular support wall converging inwardly from the side walls; and a sheet metal central web section disposed between the two chords and including a main planar web wall extending straight between another of the side walls on each of the chords, a first web wall section extending from one of the angular support walls on one of the chords, and a second web wall section extending from one of the angular support walls on another of the chords.

27. A building beam structure of claim 26 further comprising fastening devices connecting the first and second web wall sections with the main web wall.

28. A building beam structure comprising:

two sheet metal beam components, each of the beam components having a flat end wall, two opposed side walls extending from the end wall and having respective flat fastening surfaces to which materials may be connected, two angular support walls, each of the angular support walls extending from one of the side walls, and the angular support walls converging inwardly from the side walls, and two sheet metal web walls, each of the web walls extending from one of the angular support walls, the two beam components being disposed with respect to each other such that the web walls of one of the beam components overlap the web walls of the other of the beam components; and fastening devices connecting the web walls, thereby providing a beam structure having opposed end walls with intermediate and interconnected web walls.

* * * * *